United States Patent [19]

Aoki

[11] 4,294,212

[45] Oct. 13, 1981

[54] AIR-FUEL RATIO CONTROL METHOD AND APPARATUS OF AN INTERNAL COMBUSTION ENGINE

[75] Inventor: Kenji Aoki, Susono, Japan

[73] Assignee: Toyota Jidosha Kogyo Kabushiki Kaisha, Toyota, Japan

[21] Appl. No.: 895,524

[22] Filed: Apr. 11, 1978

[30] Foreign Application Priority Data

Sep. 12, 1977 [JP] Japan ..... 52-108889

[51] Int. Cl.[3] ..... F01N 3/15

[52] U.S. Cl. ..... 123/440; 123/437; 123/438

[58] Field of Search ... 123/119 EC, 32 EA, 139 AW, 123/32 EJ, 32 EE; 60/276, 285

[56] References Cited

U.S. PATENT DOCUMENTS

| | | | |
|---|---|---|---|
| 2,075,982 | 2/1978 | Asano et al. | 123/119 EC |
| 2,082,066 | 4/1978 | Long | 123/32 EA |
| 3,871,338 | 3/1975 | Schmidt et al. | 123/32 EE |
| 3,890,946 | 6/1975 | Wahl | 123/139 AW |
| 3,963,005 | 6/1976 | Eckert | 123/139 AW |
| 3,973,529 | 8/1976 | Wessel et al. | 123/32 EE |
| 3,983,848 | 10/1976 | Handtmann et al. | 123/32 EA |
| 4,020,256 | 5/1977 | Fenn | 123/119 EC |
| 4,031,873 | 6/1977 | Banzhaf et al. | 123/139 AW |
| 4,036,186 | 7/1977 | Hattori et al. | 123/32 EE |
| 4,052,968 | 10/1977 | Hattori et al. | 123/32 EE |
| 4,073,269 | 2/1978 | Herth et al. | 123/32 EE |
| 4,075,982 | 2/1978 | Asana et al. | 123/119 EC |
| 4,077,207 | 3/1978 | Hattori et al. | 123/119 EC |
| 4,082,066 | 4/1978 | Long | 123/32 EA |
| 4,084,563 | 4/1978 | Hattori et al. | 123/119 EC |
| 4,089,313 | 5/1978 | Asano et al. | 123/119 EC |
| 4,094,273 | 6/1978 | Hattori et al. | 123/32 EE |
| 4,119,072 | 10/1978 | Asano | 123/119 EC |
| 4,132,200 | 1/1979 | Asano et al. | 123/119 EC |
| 4,136,645 | 1/1979 | Ito et al. | 123/119 EC |
| 4,140,093 | 2/1979 | Hattori et al. | 123/119 EC |
| 4,171,690 | 10/1979 | Hosaka et al. | 123/119 EC |

*Primary Examiner*—Charles J. Myhre
*Assistant Examiner*—R. A. Nelli
*Attorney, Agent, or Firm*—Stevens, Davis, Miller and Mosher

[57] ABSTRACT

Disclosed ia an air-fuel ratio control method and apparatus of an internal combustion engine. The control of the air-fuel ratio is accomplished by controlling the amount of fuel provided into the engine according to a plurality of separate electrical engine condition signals which indicate the operating condition of the engine, and according to an electrical air-fuel ratio correction signal which is determined in accordance with the air-fuel ratio of the engine. The value of at least one of the engine condition signals is corrected according to a signal which indicates a mean value of the air-fuel ratio correction signal. The correcting operation is executed so that the value of the mean value signal becomes nearly equal to a predetermined value which corresponds to the air-fuel ratio correction signal when a desired air-fuel ratio is obtained.

9 Claims, 15 Drawing Figures

AIR-FUEL RATIO CONTROL METHOD AND APPARATUS OF AN INTERNAL COMBUSTION ENGINE

BACKGROUND OF THE INVENTION

This invention relates to an air-fuel ratio control method and apparatus of an internal combustion engine. More particularly, the invention relates to an air-fuel ratio control method and apparatus for controlling the amount of fuel injected into the engine according to various signals which indicate the operating condition of the engine and according to an air-fuel ratio signal of the engine.

There is known a technique of performing feedback control for maintaining the air-fuel ratio (if an air-fuel passage from the intake passage through the exhaust passage located upstream of an air-fuel ratio sensor is defined as a working fluid passage, the air-fuel ratio is defined as a ratio of the amount of air actually fed into the working fluid passage to the amount of fuel actually fed into the working fluid passage) within a predetermined range by controlling the basic amount of fuel injected into the engine in accordance with various separate signals used for indicating the operating condition of the engine such as an air intake signal for indicating the quantity of air taken into the engine, a pressure intake signal for indicating the level of absolute pressure in an intake manifold of the engine and a rotational speed signal for indicating the number of rotations per minute or the rotational speed of the engine, and for correcting this basic amount of fuel to be injected into the engine in accordance with a detection signal from an air-fuel ratio sensor, for example, from an oxygen concentration sensor disposed in the exhaust system of the engine. According to this controlling method, it is possible to improve the exhaust gas purifying efficiency of a three-way catalytic converter disposed in the exhaust system of the engine. The reason for this is that the three-way catalytic converter which simultaneously reduces the three basic pollutants, CO, HC and $NO_x$, exerts the highest degree of purifying efficiency when the air-fuel ratio is maintained within a narrow air-fuel ratio range in the vicinity of the stoichiometric air-fuel ratio.

In the conventional control apparatus of this type, however, since the detection response of the air-fuel ratio sensor is delayed when the engine is in a transitional condition and furthermore, since a time lag caused by the transmission of the air-fuel mixture from the intake system to the exhaust system exists in the engine, a problem sometimes occurs in that the air-fuel ratio feedback control cannot be carried out in response to the actual operating condition of the engine. Accordingly, in this case, the fuel injection amount is not corrected by the detection signal from the air-fuel ratio sensor, and thus, the fuel injection amount becomes equal to the basic injection amount calculated in accordance with various signals which indicate the operating condition of the engine. Therefore, while the feedback control is not carried, the air-fuel ratio of the engine coincides with the value determined in accordance with the basic injection amount. As a result, this air-fuel ratio deviates from the stoichiometric air-fuel ratio, the purifying efficiency of the three-way catalytic converter is reduced in proportion to this deviation, and large quantities of harmful pollutants in the exhaust gas are discharged from the engine.

SUMMARY OF THE INVENTION

It is, therefore, an object of the present invention to provide an air-fuel ratio control method and apparatus of an internal combustion engine by which the air-fuel ratio can be controlled within a predetermined range even when the engine is in a transitional condition.

The method and the apparatus of the present invention concerns the control of the air-fuel ratio of the air-fuel mixture in an internal combustion engine. The control of the air-fuel ratio is carried out by controlling the amount of fuel provided into the engine according to separate electrical engine condition signals which indicate the operating condition of the engine, and according to an electrical air-fuel ratio correction signal which is determined in accordance with the air-fuel ratio of the engine. In the method of the present invention, the value of at least one of the engine condition signals is corrected according to a signal which corresponds to the mean value of the air-fuel ratio correction signals. The above-mentioned correction of an engine condition signal is performed until the mean value signal becomes nearly equal to a predetermined value which corresponds to the air-fuel ratio correction signal when the air-fuel ratio is at a desired value.

The apparatus of the present invention comprises means for generating an electrical air-fuel ratio correction signal in accordance with the air-fuel ratio of the engine; means for generating electrical engine condition signals which indicate the operating condition of the engine; means for controlling the amount of fuel provided into the engine according to the engine condition signals and to the air-fuel ratio correction signal; means for generating an electrical signal which corresponds to the mean of the air-fuel ratio correction signals; and means for correcting the value of at least one of the engine condition signals, which are used for controlling the amount of fuel provided into said engine, according to the generated mean value signal until the mean value signal becomes nearly equal to a predetermined value which corresponds to the air-fuel ratio correction signal at the time the air-fuel ratio is at a desired value.

The above and other related objects and features of the present invention will become more apparent from the description set forth below with reference to the accompanying drawings and from the appended claims.

DETAILED DESCRIPTION OF THE INVENTION

Figure 1:
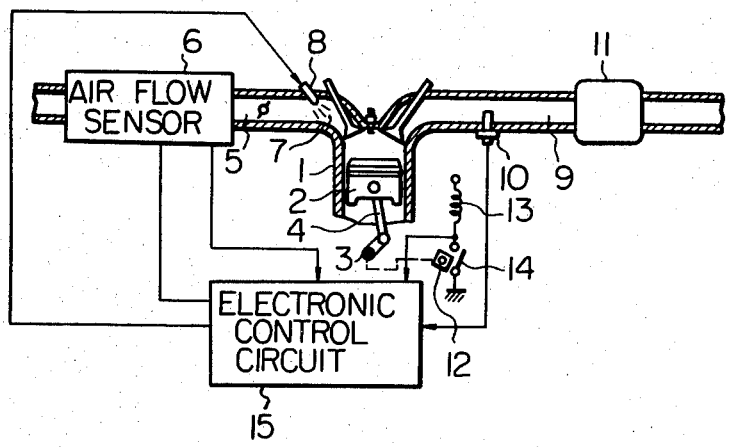
FIG. 1 is a schematic diagram illustrating an internal combustion engine to which one embodiment of the present invention is applied.

Referring to FIG. 1 which is a diagram illustrating an internal combustion engine to which one embodiment of the present invention is applied, reference numeral 1 represents a cylinder of the engine. A piston 2 is located in the cylinder 1. A crankshaft 3 is connected to the piston 2 through a connecting rod 4. An air-flow sensor 6 is mounted on an intake pipe 5 of the engine. A fuel injection valve 8 is disposed on an intake manifold 7 connected downstream to the intake pipe 5. An air-fuel ratio sensor 10 is mounted on an exhaust pipe 9 of the engine, and a three-way catalytic converter 11 is disposed in the exhaust pipe 9 at a position located downstream of the air-fuel ratio sensor 10. A contact breaker cam 12 is connected to the crankshaft 3 through a reduction gear mechanism (not shown). This cam 12 is arranged so that it opens or closes contact breaker points 14 which are electrically connected in series to a primary winding 13 of an ignition coil (not shown). An output terminal of the air flow sensor 6, one end of an exciting coil (not shown) of the fuel injection valve 8, an output terminal of the air-fuel ratio sensor 10, and one end of the primary winding 13 of the ignition coil are electrically connected to an electronic control circuit 15.

Figure 3:
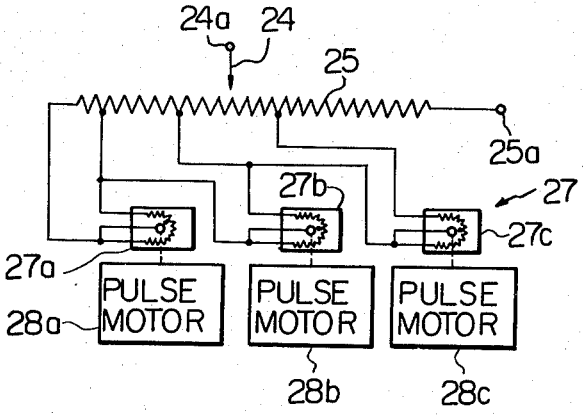
FIG. 3 is a block diagram of an electrical structure of the air flow sensor illustrated in FIGS. 2*a* and 2*b;*
Figure 2A:
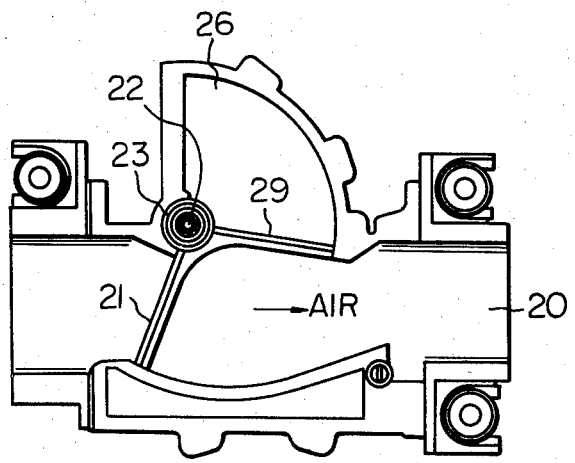
FIGS. 2*a* and 2*b* are a sectional view and a perspective view, respectively, of an air flow sensor illustrated in FIG. 1.
Figure 2B:
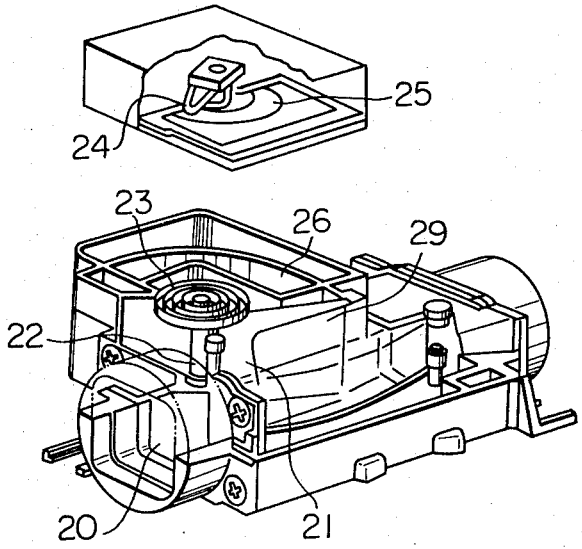

The air-flow sensor 6 detects the quantity of air sucked into the engine and also performs the operation of correcting a signal of such detection. The sensor 6 has a structure as illustrated in FIGS. 2*a*, 2*b* and 3. The structure of the air flow sensor 6 will now be described.

The air-flow sensor 6 has in a housing thereof an intake air passage 20. A flow amount measuring plate 21 is disposed in the intake air passage 20. This measuring plate 21 is fixed to a rotatable shaft 22 which is rotatably supported on the housing. A spiral spring 23 is disposed between the rotatable shaft 22 and the housing, and the flow amount measuring plate 21 is pressed by this spiral spring 23 in a clockwise direction in FIG. 2*a* so that when the intake air flows in a direction indicated by the arrow in the intake air passage 20, the flow amount measuring plate 21 is rotated in a counterclockwise direction in FIG. 2*a*, and the angular position of the rotatable shaft 22 is varied according to changes in the amount of the intake air. By this counterclockwise rotation of the measuring plate 21, a sliding rotor 24 connected to the rotatable shaft 22 is slid onto a fixed sliding resistor 25. As a result, the value of the electric resistance between one end of the fixed sliding resistor 25 and the sliding rotor 24 is changed, and a terminal voltage which is inversely proportional to the amount of the intake air can be obtained. In FIGS. 2*a* and 2*b*, reference numerals 26 and 29 represent a damper chamber and a damper plate, respectively. According to the present invention as illustrated in FIG. 3, a potential dividing resistor 27 is connected in parallel to the fixed sliding resistor 25. This potential dividing resistor 27 comprises a plurality of rheostats arranged so that they are driven by a plurality of pulse motors, respectively. More specifically, as illustrated in FIG. 3, a plurality (three in the case of FIG. 3) of rheostats 27*a*, 27*b* and 27*c* are connected to the sliding resistor 25 in parallel, and the driving shafts of pulse motors 28*a*, 28*b* and 28*c* are connected to the rotatable shafts of these rheostats, respectively. Accordingly, the resistance between one end 25*a* of the sliding resistor 25 and the output terminal 24*a* of the sliding rotor 24 is corrected according to the degree of rotation of each pulse motor.

In FIG. 1, fuel is supplied under a predetermined pressure to the fuel injection valve 8 by a fuel supply system (not shown). The fuel is fed into the intake manifold 7 in an amount corresponding to the period during which the exciting coil of the fuel injection valve 8 is energized.

The air-fuel ratio sensor 10 is, for example, an oxygen concentration sensor comprising zirconium oxide as an oxygen ion conductor. This air-fuel ratio sensor 10 is arranged so that when the air-fuel ratio is lower than the stoichiometric air-fuel ratio, namely when the exhaust gas is in a rich condition, an output voltage of about 1 V is generated, and that when the air-fuel ratio is higher than the stoichiometric air-fuel ratio, namely when the exhaust gas is in a lean condition, an output voltage of about 0.1 to 0.2 V is generated.

Figure 4A:
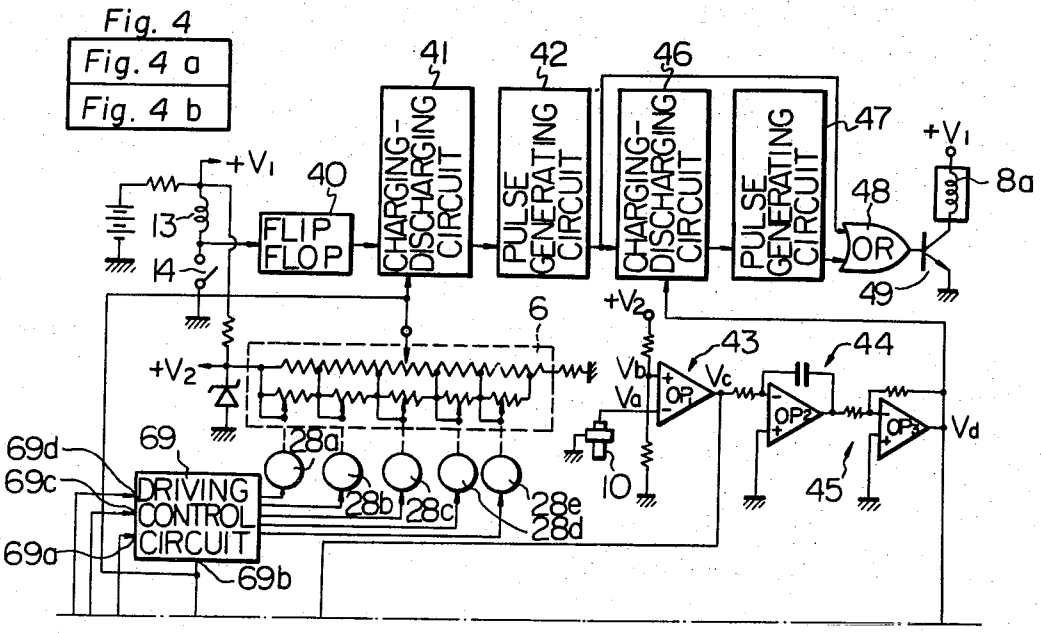
FIGS. 4*a* and 4*b* are a block diagram of an electronic control circuit illustrated in FIG. 1.
Figure 4B:
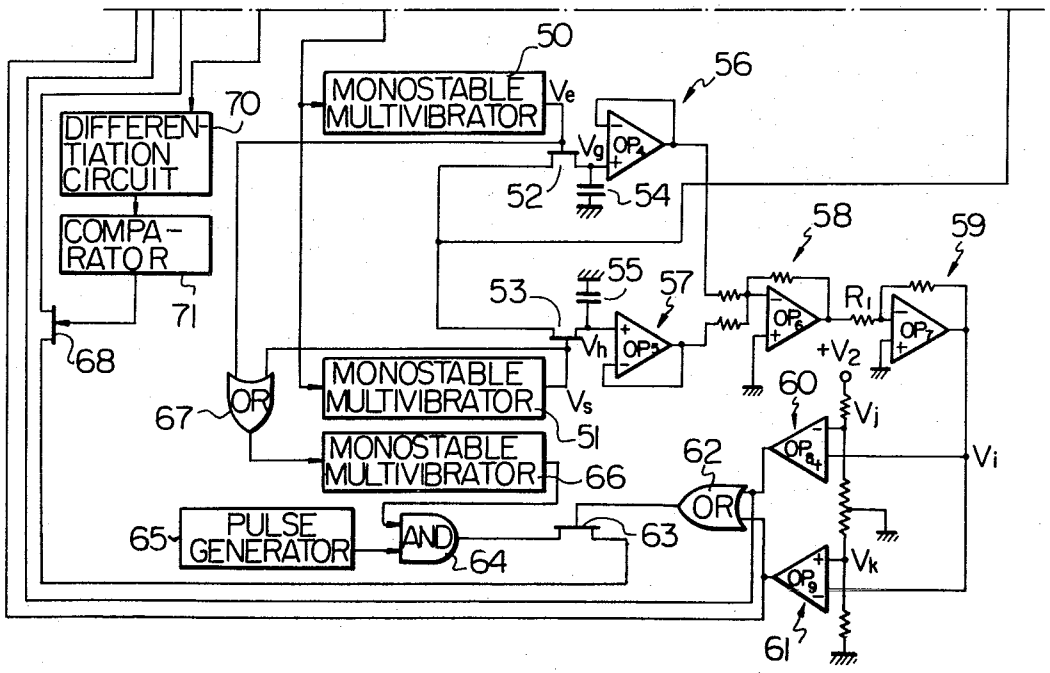

FIG. 4 is a detailed block diagram illustrating the electrical structure of the electronic control circuit 15. This electronic control circuit 15 includes three main circuits, such as a basic injection period setting circuit, an air-fuel ratio correction setting circuit and a basic injection period correcting circuit. The basic injection period setting circuit yields pulses having a duration corresponding to the basic injection period which is determined by using separate engine condition signals indicating the operating condition of the engine. The air-fuel ratio correction setting circuit corrects the duration of the pulses which is determined by the basic injection period setting circuit in accordance with the air-fuel ratio. The basic injection period correcting circuit corrects the value of at least one of the engine condition signals in accordance with a signal provided from the air-fuel ratio correction setting circuit.

The structure of the basic injection period setting circuit is known from, for example, Japanese Patent Laid-Open Publications Nos. 47-9,751 and 49-67,016. The structure and operation of this circuit will now be briefly described.

Referring to FIG. 4, this basic injection period setting circuit comprises a flip-flop 40 connected to the contact breaker points 14, a first charging-discharging circuit 41, which has one input terminal connected to the output terminal of the flip-flop 40, and a first pulse generating circuit 42 connected to the output terminal of the first charging-discharging circuit 41.

Figure 6A:
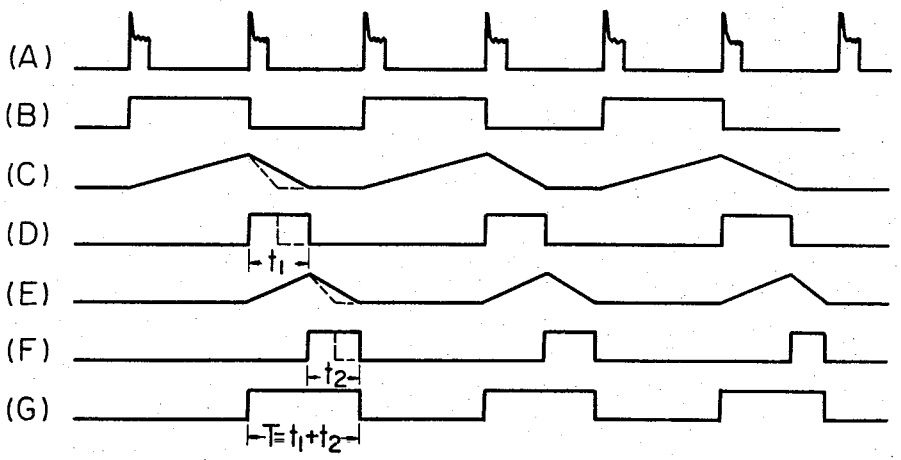
FIGS. 6*a* and 6*b* show waveforms obtained at various points in the circuit illustrated in FIG. 4.
Figure 6B:
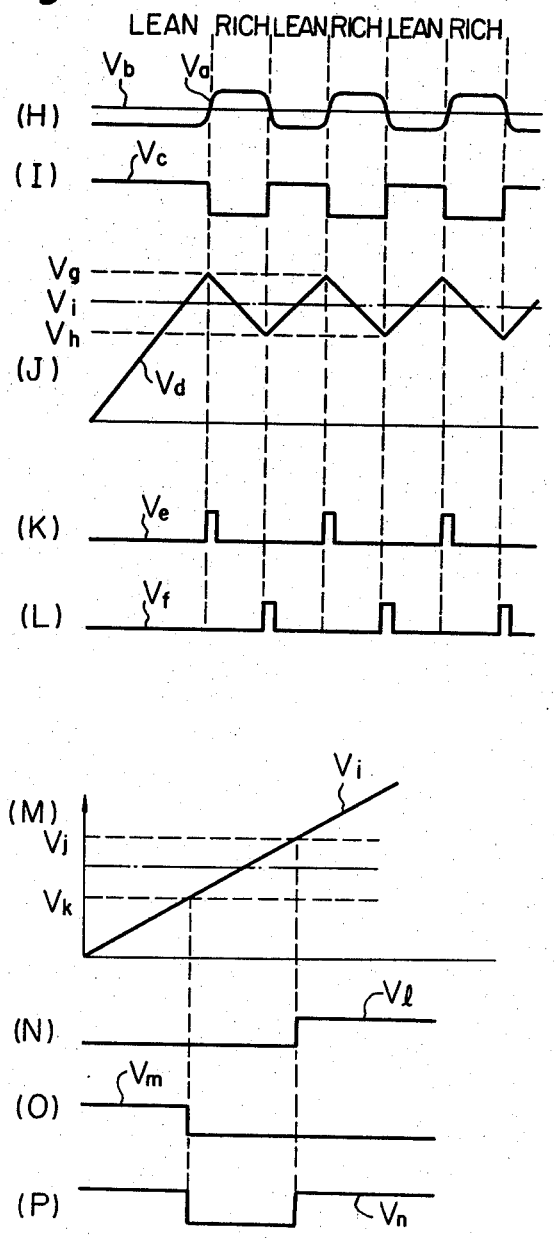

When the contact breaker points 14 perform the opening or closing operation according to the rotation of the engine, a signal having a waveform as shown in FIG. 6*a*-(A) is applied to the flip-flop 40, and on receiving this input signal, the flip-flop 40 repeats the setting and resetting operations and generates an output voltage as shown in FIG. 6*a*-(B). Namely, the frequency of the output pulse of the flip-flop 40 is directly proportional to the engine's rotation number N per minute. In other words, the width of the output pulse of the flip-flop 40 is inversely proportional to the engine's rotation number N per minute. The first charging-discharging circuit 41 has a charge and discharge capacitor. When the input signal of the circuit 41 is at a high level, the charging operation of the capacitor is carried out with a particular charging current. Accordingly, the level of the output voltage of the charging-discharging circuit 41 at the time the charging operation is completed corresponds to the width of the output pulse produced by the flip-flop 40, namely, the output voltage level is inversely proportional to the engine's rotation number N per minute, as shown in FIG. 6*a*-(C). When the input signal of the charging-discharging circuit 41 is changed to a low level, this circuit 41 performs the discharging operation. The output terminal of the air-flow sensor 6 is connected to the other input terminal of the charging-discharging circuit 41, and the level of the discharge current during the above discharging operation is controlled by the output voltage of the air-flow sensor 6. More specifically, when the quantity Q of intake air of the engine is large, since the level of the output voltage of the air-flow sensor 6 is reduced as pointed out hereinbefore, the above-mentioned discharging current is lowered, and accordingly, in this case, the level of the output voltage of the first charging-discharging circuit 41 is gradually reduced as indicated by the solid line in FIG. 6*a*-(C). In contrast, when the quantity Q of intake air of the engine is small, the discharging current is enhanced and the level of the output voltage of the first charging-discharging circuit 41 is abruptly reduced as indicated by the broken line in FIG. 6*a*-(C).

The output voltage of the first charging-discharging circuit 41 is applied to the first pulse generating circuit 42 where a pulse having a pulse width $t_1$ equal to the period between completion of the charging operation and completion of the discharging operation in the charging-discharging circuit 41 is generated. FIG. 6*a*-(D) shows the waveform of this output pulse of the first pulse generating circuit 42. In the first charging-discharging circuit 41, the level of the output voltage at the time the charging operation is completed is inversely proportional to the engine's rotation number N per minute, and the discharging current is proportional to the quantity Q of intake air in the engine. Accordingly, the pulse width $t_1$ of the output pulse of the pulse generating circuit 42 is expressed as $t_1 \propto Q/N$.

The structure and operation of the air-fuel ratio correction setting circuit, which is also known in this art, will now be described. This air-fuel ratio correction setting circuit comprises a comparator 43 connected to the output terminal of the air-fuel ratio sensor 10, an integrator 44 connected to the output terminal of the comparator 43, a second charging-discharging circuit 46 having one input terminal connected to the output terminal of the integrator 44 through an inverter 45 and the other input terminal connected to the output terminal of the above-mentioned first pulse generating circuit 42, a second pulse generating circuit 47 connected to the output terminal of the second charging-discharging circuit 46 and an OR circuit connected to the output terminals of the first and second pulse generating circuits 42 and 47. The output terminal of the OR circuit 48 is connected to a base of a switching transistor 49 for controlling the operation of the fuel injection valve 8, which is connected in series to the exciting coil 8*a* of the fuel injection valve 8.

The output voltage Va of the air-fuel ratio sensor 10 having a waveform as shown in FIG. 6*b*-(H) is applied to the comparator 43 including an operational amplifier $OP_1$ and is inversely compared with the standard voltage Vb of about 0.45 V. Accordingly, the waveform of the output voltage Vc of the comparator 43 is as shown in FIG. 6*b*-(I). This output voltage Vc of the comparator 43 is applied to the integrator 44 including an operational amplifier $OP_2$ and is integrated therein. Then the output of the integrator 44 is inverted in the inverter 45 which includes an operational amplifier $OP_3$. Accordingly, the waveform of the output voltage Vd of the inverter 45 is as shown in FIG. 6*b*-(J). This output voltage, namely the air-fuel ratio correction signal Vd, is applied to the second charging-discharging circuit 46. The output pulse, as shown in FIG. 6*a*-(D), of the above-mentioned first pulse-generating circuit 42 is applied to the second charging-discharging circuit 46. This second charging-discharging circuit 46 includes a charge and discharge capacitor when the input signal of the circuit 46 is at a high level, this capacitor is charged with a certain charging current. Accordingly, the output voltage of this second charging-discharging circuit 46 at the time the charging operation is ended has a level proportional to the pulse width $t_1$ of the first pulse generating circuit 42, namely, proportional to the value of Q/N, as shown in FIG. 6*a*-(E). When the level of the input signal provided from the first pulse generating circuit 42 is changed to a low level, the second charging-discharging circuit 46 performs the discharging operation. The discharge current at this discharging operation is controlled so as to be inversely proportional to the level of the voltage applied from the inverter 45. More specifically, when the level of the voltage applied from the inverter 45 is high, the level of the output voltage of the second charging-discharging circuit 46 is gradually reduced as shown by a solid line in FIG. 6*a*-(E), and when the level of the voltage applied from the inverter 45 is low, the discharge current becomes large and the level of the output voltage of the second charging-discharging circuit 46 is abruptly reduced as shown by a broken line in FIG. 6*a*-(E).

The output voltage of the second charging-discharging circuit 46 is applied to the second pulse generating circuit 47, and a pulse, as shown in FIG. 6*a*-(F), having a pulse width $t_2$ equal to the period between completion of the charging operation of the second charging-discharging circuit 46 and completion of the discharging operation of the circuit 46 is generated. Namely, this pulse width $t_2$ corresponds to the level of the output voltage of the inverter 45. Both output voltages of the first and second pulse generating circuits 42 and 47 are simultaneously applied to the OR circuit 48, and therefore, a logical sum of these applied output voltages can be obtained. Accordingly, the pulse width T of the output pulse of the OR circuit 48 is expressed as $T=t_1+t_2$ as shown in FIG. 6*a*-(G). Therefore, when the air-fuel ratio is on the lean side of the stoichiometric condition, since the output voltage of the inverter 45 has a positive inclination as shown in FIG. 6*b*-(J), the above-mentioned pulse width T is gradually increased, and on the other hand, when the air-fuel ratio is on the rich side of the stoichiometric condition, the pulse width T is gradually decreased. When the output pulse of the OR circuit 48 is applied to a base of the switching transistor 49, the exciting coil 8*a* is energized, and therefore the fuel injection valve 8 is opened during a period of time corresponding to the above-mentioned output pulse width T, and the fuel is thereby supplied to the engine.

When the fuel injection controlling apparatus of the engine is composed of only the above-mentioned basic injection period setting circuit and the air-fuel ratio correction setting circuit, there is no problem of air-fuel ratio control while the engine is in a normal steady operating condition. More specifically, even if the air-fuel ratio, which is controlled according to the basic fuel injection amount calculated from the quantity of intake air of the engine and the rotational speed of the engine, (hereinafter referred to as "basic air-fuel ratio") deviates from the stoichiometric air-fuel ratio, since the air-fuel ratio feedback control is executed, the air-fuel ratio which is controlled according to the corrected fuel injection amount (hereinafter referred to as the "corrected air-fuel ratio") is substantially equal to the stoichiometric air-fuel ratio. However, when the engine is in the transitional condition, there is a risk that the corrected air-fuel ratio will deviate greatly from the stoichiometric air-fuel ratio. This undesirable phenomenon will now be described.

Figure 7:
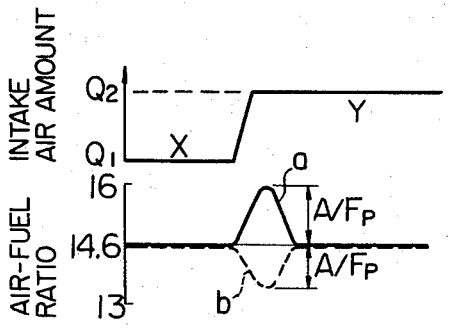
FIGS. 7 and 8 are graphs illustrating the transitional characteristics of the air-fuel ratio according to the conventional technique.
Figure 8:
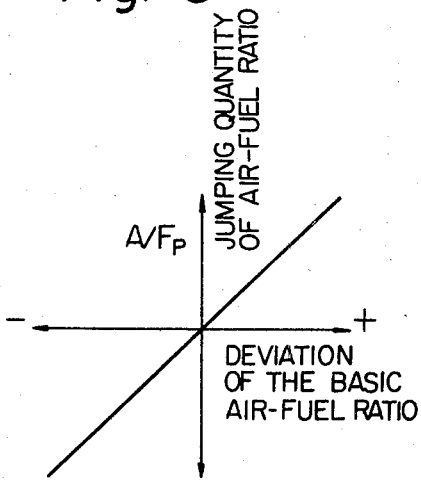

Referring to FIG. 7, it should be assumed that the quantity of intake air of the engine is $Q_1$ in the region X and $Q_2$ in the region Y and that the basic air-fuel ratio in the region Y is equal to the stoichiometric air-fuel ratio, but that the basic air-fuel ratio in the region X is deviated from the stoichiometric air-fuel ratio, for example, to the lean side of the stoichiometric condition and this deviation is being compensated for by the air-fuel ratio correction signal supplied by the air-fuel ratio correction setting circuit. If the operating condition of the engine is abruptly changed from the region X to the region Y, the amount of the fuel in the initial stage of the operation in the region Y is increased even though such increase in the amount of fuel is unnecessary due to the delay of the air-fuel ratio sensor and to the transmission delay of the mixture of the engine or the like. Accordingly, in this case, the air-fuel ratio jumps to the rich side as indicated by the broken line b in FIG. 7. In contrast, when the basic air-fuel ratio in the region X is deviated to the rich side, as indicated by the solid line a in FIG. 7, the air-fuel ratio jumps to the lean side. As shown in FIG. 8, the larger the deviation of the basic air-fuel ratio from the stoichiometric air-fuel ratio, the longer the jumping of the air-fuel ratio within both sides.

The basic injection period correcting circuit described hereinafter is provided in this embodiment of the present invention in order to eliminate the above-described disadvantage, whereby the basic air-fuel ratio is controlled so that the above deviation of the air-fuel ratio is reduced to a practically negligible low level. The structure and operation of this basic injection period correcting circuit which constitutes one characteristic feature of the present invention, will now be described.

As illustrated in FIG. 4, the output terminal of the comparator 43 is connected to the input terminal of a negative edge triggering monostable multivibrator 50 which is triggered by the negative edge of the input voltage and also connected to the input terminal of a positive edge triggering monotable multivibrator 51 which is triggered by the positive edge of the input voltage. Accordingly, waveforms of the output voltages Ve and Vf of these monostable multivibrators 50 and 51 are formed as shown in FIGS. 6*b*-(K) and 6*b*-(L), respectively. Switching transistors 52 and 53 are disposed between the inverter 45 and a charging capacitor 54 and between the inverter 45 and a charging capacitor 55, respectively. Accordingly, when the switching transistors 52 and 53 become conductive as a result of the pulses Ve and Vf applied from the monostable multivibrators 50 and 51, each of the capacitors 54 and 55 is charged with a voltage level which is equal to the level of the output voltage of the inverter 45.

More specifically, the terminal voltage of the capacitor 54 becomes the output voltage of the inverter 45, namely the air-fuel ratio correction signal Vg (shown in FIG. 6*b*-(J)), at the time the air-fuel ratio is changed to the rich side from the lean side, and the terminal voltage of the capacitor 55 becomes the air-fuel ratio correction signal Vh (shown in FIG. 6*b*-(J)) at the time when the equivalent air-fuel ratio is changed to the rich side from the lean side. The terminal voltages of the capacitors 54 and 55 are applied to a summing circuit 58 through buffer circuits 56 and 57 including operational amplifiers $OP_4$ and $OP_5$, respectively. The summing circuit 58 is an ordinary circuit comprising an operational amplifier $OP_6$ and the like. The input terminal of the summing circuit 58 is connected to the above-mentioned buffer circuits 56 and 57, and the output terminal of the summing circuit 58 is connected to the input terminal of an ordinary inverting amplifier 59 comprising an operational amplifier $OP_7$ and resistors R1 and R2. The ratio of the resistance values of the input resistor R1 and the feedback resistor R2 of the inverting amplifier 59 is adjusted to 2:1. Accordingly, as shown in FIG. 6*b*-(J), the output voltage Vi of the inverting amplifier 59 is expressed as $Vi=(Vg+Vh)/2$. The output terminal of the inverting amplifier 59 is connected to input terminals of comparators 60 and 61 comprising operational amplifiers $OP_8$ and $OP_9$, respectively. These comparators 60 and 61 and an OR circuit 62 connected to the output terminals of these comparators 60 and 61 constitute a so-called window-type comparing circuit. More specifically, the comparator 60 has an upper reference voltage Vj and a lower reference voltage Vk shown in FIG. 6*b*-(M). When the input signal voltage Vi is increased and becomes higher than this upper reference voltage Vj, the comparator 60 generates a high-level output Vl as shown in FIG. 6*b*-(N). When the input signal voltage Vi is decreased and becomes lower than the lower reference voltage Vk, the comparator 61 generates a high-level output Vm as shown in FIG. 6*b*-(O). Therefore, the output voltage Vn of the OR circuit 62 is elevated to a high level in the case of $Vi \leqq Vk$ or $Vj \leqq Vi$ as shown in FIGS. 6*b*-(M) and 6*b*-(P), respectively.

The output terminal of the OR circuit 62 is connected to the control signal input terminal of a switching transistor 63. Therefore, this switching transistor 63 is conductive in the case of $Vk<Vi<Vj$ and is nonconductive in the case of $Vi \leqq Vk$ or $Vj \leqq Vi$. The signal input terminal of the switching transistor 63 is connected to the output terminal of a pulse generator 65 through an AND circuit 64 and also to the output terminal of a monostable multivibrator 66 via the AND circuit 64. The input terminal of this monostable multivibrator 66 is connected to the output terminals of the above-mentioned monostable multivibrators 50 and 51 through an OR circuit. Accordingly, each time the output voltage Vc of the comparator 43 is inverted, a pulse voltage with a predetermined pulse width is fed from the monostable multivibrator 66 and an on-off control of the AND circuit 64 is performed. Accordingly, a predetermined number of output pulses of the pulse generator 65 are applied to the switching transistor 63 each time the output signal of the air-fuel ratio sensor 10 is inverted. When the output voltage Vi of the inverting amplifier 59 is at the level of $Vi \leqq Vk$ or $Vj \leqq Vi$, the applied output pulses pass through the switching transistor 63.

The output terminal of the switching transistor 63 is connected to a pulse input terminal 69*a* of a pulse motor driving control circuit 69 via a switching transistor 68. The control signal input terminal of the switching transistor 68 is connected to the output terminal of a circuit for detecting the normal steady operation of the engine, which comprises a differentiation circuit 70 and a comparator 71. The input terminal of this detecting circuit is connected to the output terminal of the air flow sensor 6. This detecting circuit discriminates the normal steady operation of the engine by detecting changes in the quantity of intake air of the engine by means of the differentiation circuit 70 and by judging that the detected change is smaller than the predetermined value by means of the comparator 71. Only during the normal steady operation of the engine, the discriminating circuit applies an output voltage of a high level to the switching transistor 68 to conduct the transistor 68 and to supply the output pulse from the above-mentioned switching transistor 63 to the pulse motor driving control circuit 69.

Figure 5:
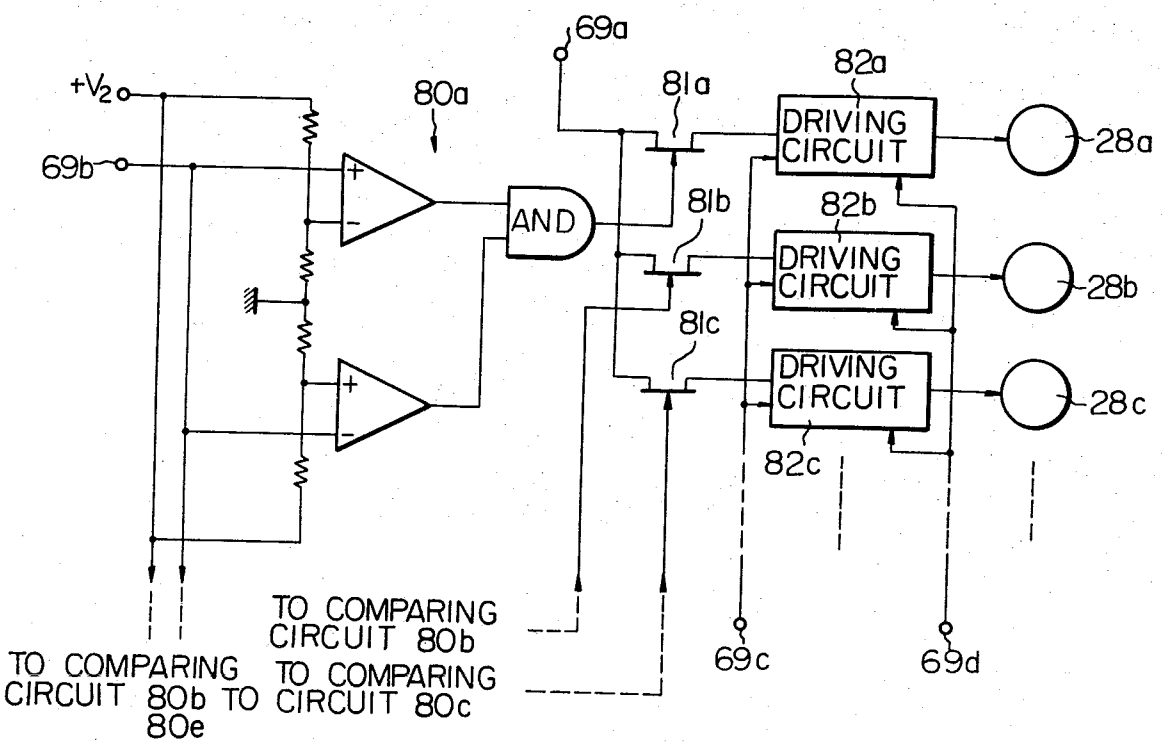
FIG. 5 is a detailed block diagram of a driving control circuit illustrated in FIG. 4.

A control signal input terminal 69*b* of the pulse motor driving control circuit 69 is connected to the output terminal of the air-flow sensor 6, and rotation direction signal input terminals 69*c* and 69*d* of the circuit 69 are connected to the output terminals of the comparators 60 and 61, respectively. FIG. 5 is a block diagram illustrating in detail a part of this pulse motor driving control circuit 69. The structure and operation of the pulse motor driving control circuit 69 will now be described with reference to FIG. 5.

The control signal input terminal 69*b* which is connected to the output terminal of the air-flow sensor 6 as described hereinbefore is also connected to a window-type comparing circuit 80*a*. This comparing circuit having two predetermined reference voltages generates a signal of a high level when the input signal has a value between the two predetermined reference voltages. Comparing circuits 80*a* through 80*e* which have different predetermined reference voltages are provided for each of the pulse motors 28*a* through 28*e*, respectively, although not specifically shown in FIG. 5. The output terminals of the comparing circuits 80*a* through 80*e* are respectively connected to control signal input terminals of the switching transistors 81*a* through 81*e* for the respective pulse motors 28*a* through 28*e*. The other input terminals of the switching transistors 81*a* through 81*e* are connected to the pulse input terminal 69*a*. The output terminals of these switching transistors are connected to input terminals of driving circuits 82*a* through 82*e* provided for the respective pulse motors 28*a* through 28*e*. Therefore, according to the output voltage of the air-flow sensor 6, the specific switching transistor in the switching transistors 81*a* through 81*e* conducts and the above-mentioned pulse is applied to the corresponding driving circuit to drive the pulse motor connected thereto. The corresponding rheostat in the above-mentioned poetential dividing resistor 27 of the air-flow sensor 6 is thereby controlled. Each of the driving circuits 82*a* through 82*e* functions as an ordinary driving circuit for a pulse motor. The rotation direction of the pulse motor is controlled according to a signal applied via the rotation direction signal input terminals 69*c* and 69*d* from the comparators 60 and 61, respectively. More specifically, in the case of $Vj \leqq Vi$ where the basic air-fuel ratio is in the lean side, the above-mentioned potential dividing resistor 27 is controlled so that the output voltage of the air-flow sensor 6 is lowered, and in the case of $Vi \leqq Vk$ where the basic air-fuel ratio is on the rich side, the resistor 27 is controlled so that the output voltage of the air-flow sensor 6 is increased. Therefore, if the above-mentioned structure of the present embodiment is adopted, since the basic air-fuel ratio is always controlled automatically so that the ratio is substantially equal to the stoichiometric air-fuel ratio, occurrences of the jumping phenomenon of the air-fuel ratio in the transitional condition of the engine can be prevented irrespective of the characteristics of the air-fuel ratio sensor and engine, and the exhaust gas purifying effect can accordingly be remarkably improved. Furthermore, even if the air-fuel ratio sensor becomes inactive or malfunctions, since the basic air-fuel ratio has already been corrected, reduction of the exhaust gas purifying effect can be prevented.

The present invention can be realized in not only an analogue type control apparatus as illustrated in the foregoing first embodiment but also in a digital type control apparatus. The present invention will now be described with reference to a second embodiment in which a digital type air-fuel ratio control apparatus using a digital computer is employed.

Figure 9:
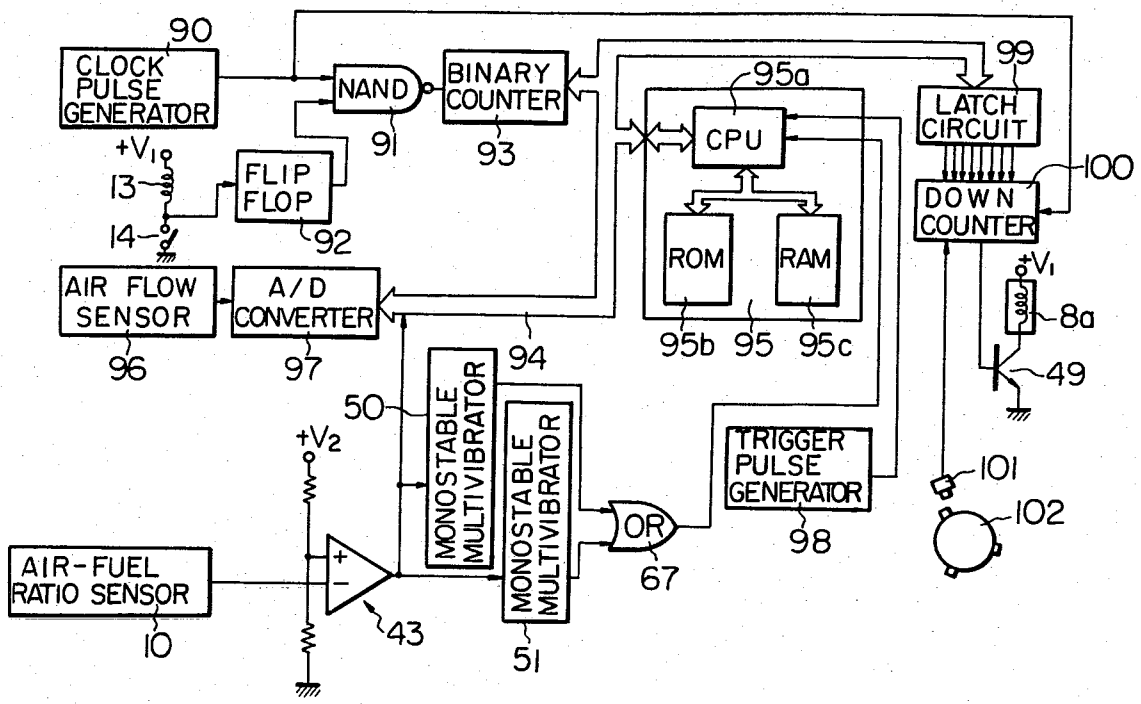
FIG. 9 is a block diagram of an electronic control circuit in another embodiment according to the present invention.

FIG. 9 is a block diagram illustrating the above-mentioned apparatus to be used in the second embodiment of the present invention. In FIG. 9, reference numeral 90 represents a clock pulse generator which is connected to one input terminal of a logical product circuit, which in this embodiment is a NAND circuit 91. The other input terminal of the NAND circuit 91 is connected to the output terminal of a flip-flop 92 actuated by an input voltage provided from the primary winding 13 of the ignition coil. The output terminal of NAND circuit 91 is connected to a clock pulse input terminal of presettable binary counter 93. The pulse width of the output pulse of the flip-flop 92 is inversely proportional to the rotation number N per minute of the engine, as well as that of the flip-flop 40 of the first embodiment. Accordingly, the number of clock pulses applied via the NAND circuit 91 to the binary counter 93 and counted thereby is inversely proportional to the above-mentioned engine's rotation number N per minute. The output terminal of the binary counter 93 is connected to a data bus 94 of a digital micro-computer 95. The output terminal of an air-flow sensor 96, which has the same structure as that of the air-flow sensor 6 in the first embodiment except that the potential dividing resistor and pulse motors are omitted therefrom, is connected to the data bus 94 of the micro-computer 95 through an analogue-digital converter (A/D converter) 97. The structures and operations of the air-fuel ratio sensor 10, comparator 43, negative edge triggering monostable multivibrator 50, positive edge triggering monostable multivibrator 51 and OR circuit 67 are the same as those of the first embodiment. In this second embodiment, however, the output terminal of the OR circuit 67 is connected to a first interruption pulse input terminal of the micro-computer 95. The output terminal of the comparator 43 is connected to the data bus 94 of the micro-computer 95. The output terminal of a trigger pulse generator 98 for generating pulses at a frequency much higher than the inverting frequency of output signals of the air-fuel ratio sensor 10 is connected to a second interruption pulse input terminal of the micro-computer 95. The data bus 94 of the micro-computer 95 is connected to a data input terminal of a down counter 100 through a latch circuit 99. The clock pulse input terminal of the down counter 100 is connected to the above-mentioned clock pulse generator 90. The output terminal of a magnetic pick-up transducer 101 is connected to the enable signal input terminal of the down counter 100. This magnetic pick-up transducer 101 is disposed in the vicinity of the peripheral end of a crank angle detecting disc 102 connected to the crankshaft of the engine and rotated according to the rotation of the crankshaft of the engine. Each time one of projections formed on the peripheral end portion of the disc 102 passes through the vicinity of the magnetic pick-up transducer 101, a pulse voltage is generated by the transducer 101. Namely, the magnetic pick-up transducer 101 generates a pulse per every predetermined crank angle. The output terminal of the down counter 100 is connected to the base of a switching transistor 49 for actuating an exciting coil 8*a* of the fuel injection valve 8 having the same structure as in the above-mentioned first embodiment.

Figure 10:
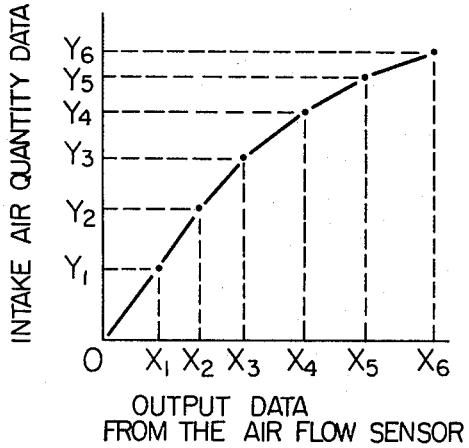
FIG. 10 is a graph illustrating the data of real intake air quantity versus corrected intake air quantity, which are stored in the digital computer.

The micro-computer 95 is an ordinary micro-computer comprising a micro-processor (CPU) 95*a*, a read-only memory (ROM) 95*b*, a random access memory (RAM) 95*c*, etc. For example, MCS-8 of Intel can be used for realizing the micro-computer 95. A predetermined program is stored in the ROM 95*b*. The RAM 95*c* comprises a RAM 1 for storing the mean value of the values of the air-fuel ratio correction signals at the time the output signal of the air-fuel ratio sensor 10 is inverted, a RAM 2 for storing correction data of the intake air quantity corresponding to the output data from the air-flow sensor 96, as shown in FIG. 10, a RAM 3 for storing the value of the air-fuel ratio correction signal, a RAM 4 for storing data corresponding to the values of the air-fuel ratio correction signals at the time the output signal of the air-fuel ratio sensor 10 is inverted from the lean side to the rich side, such data being stored in the RAM 3, and a RAM 5 for storing data corresponding to the values of air-fuel ratio correction signal at the time the output signal of the air-fuel ratio sensor 10 is inverted from the rich side to the lean side, such data being also stored in the RAM 3.

The micro-computer 95 executes the operation according to the program stored in the ROM 95*b*. In the present embodiment, the micro-computer 95 is set up so that the operation is conducted according to the interruption processing program. The operating procedures will now be described with reference to the flow diagrams shown in FIGS. 11*a* and 11*b*.

Figure 11A:
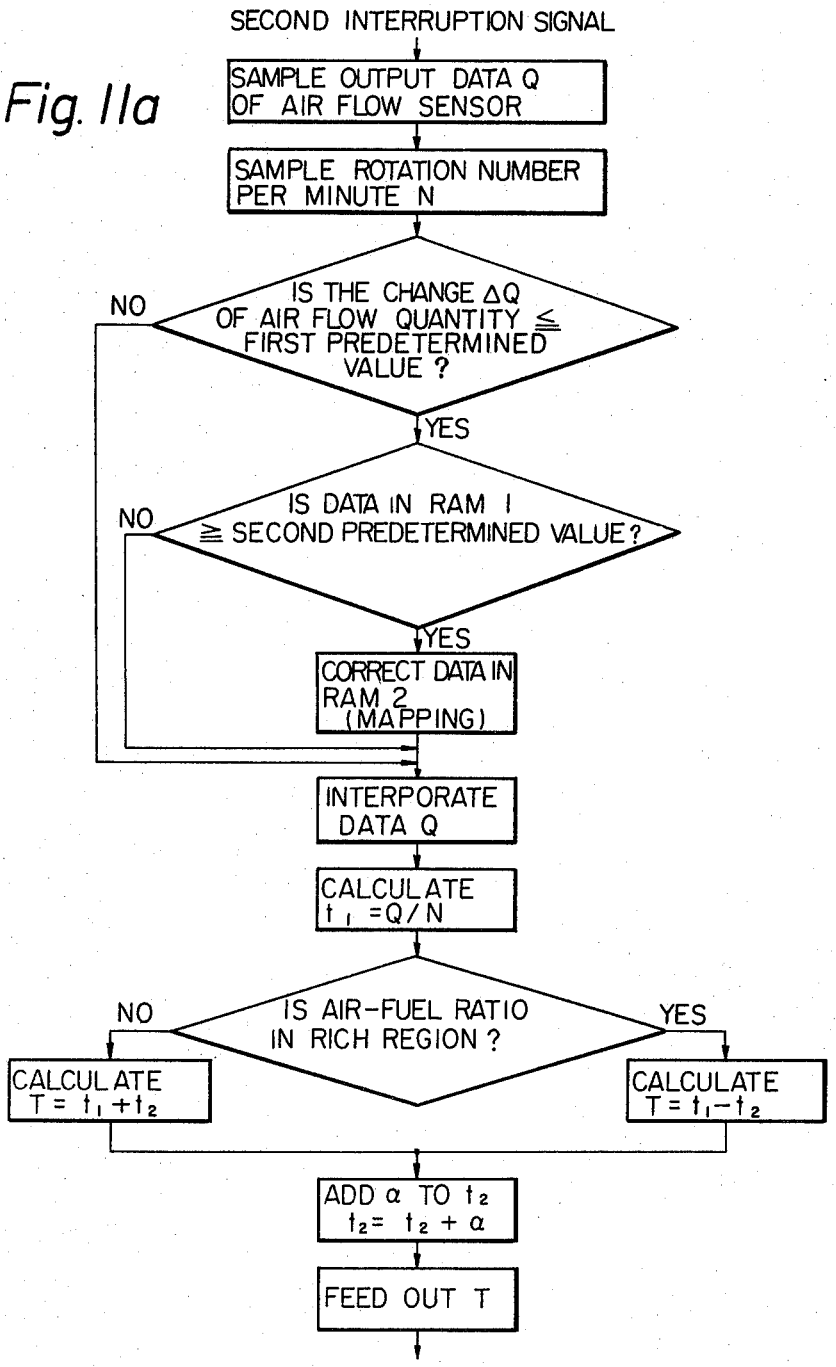
FIGS. 11*a* and 11*b* are, respectively, flow diagrams of the program stored in the digital computer in FIG. 9.

When the second interruption pulse is applied from the trigger pulse generator 98, the micro-computer 95 generates an interruption signal and, performs the second interruption processing operation according to the program shown in FIG. 11*a*. More specifically, the micro-computer 95 samples the output data of the air-flow sensor 96 concerning the intake air quantity Q of the engine from the A/D converter 97 and then samples the reciprocal number I/N of the engine's rotation number N per minute from the binary counter 93. Then, the output data of the air flow sensor concerning the intake air quantity Q' at the preceding operation are read out and subtraction is carried out between the data of the intake air quantity Q and the preceding data of the intake air quantity Q'. If the change $\Delta Q$ of the intake air quantity, which is the result of the subtraction, exceeds a first predetermined value, since the engine is not in the normal steady operation state, an interpolation operation of the intake air quantity Q is executed based on the data of RAM 2. If the change $\Delta Q$ of the intake air quantity is below the first predetermined value, the mean of the air-fuel ratio correction signals at the time of inversion of the output signal of the air-fuel ratio sensor 10, which mean value is stored in RAM 1, is compared with a second predetermined value. If the mean value is larger than the second predetermined value, the relation between the output data of the air flow sensor 96 and the intake air quantity data which are stored in RAM 2, namely correction data, is corrected so that the basic air-fuel ratio becomes equal to the stoichiometric air-fuel ratio. Then, interpolation of the intake air quantity Q is made based on the corrected data stored in the RAM 2. When the mean of the air-fuel ratio correction signals is smaller than the second predetermined value, it is judged that the basic air-fuel ratio is substantially equal to the stoichiometric air-fuel ratio, and interpolation operation of the intake air quantity Q is made without any correction of the data stored in the RAM 2. Then, calculation of $t_1=Q/N$ corresponding to the basic injection amount is executed. After that, based on the signal from the air-fuel ratio sensor 10 and, in turn, based on the signal from the comparator 43, the discrimination process for determining whether the air-fuel ratio is on the rich side or on the lean side of the stoichiometric condition is executed. If the air-fuel ratio is on the lean side, calculation of $T=t_1+t_2$ is executed, and if the air-fuel ratio is on the rich side, calculation of $T=t_1-t_2$ is executed. Incidentally, $t_2$ means the value of the air-fuel ratio correction signal stored in the RAM 3, and as described hereinafter, this value is cleared to zero each time the signal from the air-fuel ratio sensor 46 is inverted. In this second interruption processing program, a certain value $\alpha$ is added to $t_2$ after calculation of T and is then stored again in the RAM 3. This addition of $\alpha$ corresponds to the integrating operation in the above-mentioned analogue type air-fuel ratio control apparatus. Then, the result of calculation of T is fed out to the latch circuit 99.

Figure 11B:
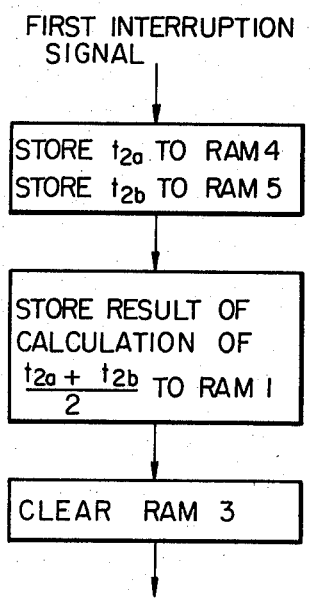

When the first interruption pulse is applied from the OR circuit 67, the micro-computer 95 generates an interruption signal and performs the first interruption process according to the program shown in FIG. 11*b*. More specifically, the value of the air-fuel ratio correction signal stored in the RAM 3 is read out and stored in the RAM 4 and the RAM 5. Since this first interruption signal is generated every time the output signal of the air-fuel ratio sensor 96 is inverted, the above value of the air-fuel ratio correction signal indicates a value at the time of inversion of the air-fuel ratio sensor 96. The value $t_{2a}$ of $t_2$, which is a transient value when the air-fuel ratio is changed from the lean side to the rich side is stored in the RAM 4, and the value $t_{2b}$, which is a transient value of $t_2$ when the air-fuel ratio is changed from the rich side to the lean side is stored in the RAM 5. Then, a calculation of $(t_{2a}+t_{2b})/2$ is made. The result of this calculation is stored in the RAM 1. Thereafter, the value $t_2$ is stored in the RAM 3 is cleared.

The data of $T=t_1+t_2$ concerning the fuel injection amount, which is applied to the latch circuit 99, is applied without delay to the down counter 100 and converted to a quantity of time. Namely, when a pulse is applied to the down counter 100 from the magnetic pick-up transducer 101 at a predetermined crank angular position, the down counter 100 starts to count the number of clock pulses fed from the clock pulse generator 90, and simultaneously, the down counter 100 generates high-level signals on the output terminal thereof, whereby the transistor 49 conducts and the exciting coil 8*a* is energized to supply the fuel to the engine. When the count value of the down counter 100 becomes a value which agrees with the input data, the transistor 49 is cut off and the supply of the fuel is stopped.

As will be apparent from the foregoing illustration, in the present second embodiment, as well as in the aforementioned first embodiment, since the air-fuel ratio is always controlled so as to be substantially equal to the stoichiometric air-fuel ratio, occurrence of the jumping phenomenon of the air-fuel ratio in the transitional condition of the engine can be prevented irrespective of the characteristic properties of the air-fuel ratio sensor and the engine. Accordingly, the exhaust gas purifying effect can be remarkably improved. Further, even when the air-fuel ratio sensor is inactive or malfunctions, since the basic air-fuel ratio is corrected in advance, reduction of the exhaust gas purifying effect and degradation of the operational characteristics of the engine can be prevented.

In the foregoing embodiments, the signals of the intake air quantity and the rotational speed of the engine are used as signals indicating the operating condition of the engine. In some embodiments of the present invention, signals of the vacuum in the intake manifold and of the rotational speed may be used instead.

As many widely different embodiments of the present invention may be constructed without departing from the spirit and scope of the present invention, it should be understood that the invention is not limited to the specific embodiments described in this specification, except as defined in the appended claims.

What is claimed is:

1. An air-fuel ratio control method for adjusting the amount of fuel permitted to flow into an internal combustion engine in accordance with engine condition signals comprising the steps of:

detecting engine operating conditions;

generating said engine condition signals from said detected engine operating conditions, said engine condition signals being related to said detected engine operating conditions in accordance with predetermined functional relationships;

adjusting the amount of fuel permitted to flow into said engine in accordance with said engine condition signals;

sensing the concentration of a predetermined exhaust gas component in the exhaust gas of said engine and generating a detected component concentration signal;

producing an air-fuel ratio correction signal by integrating said detected component concentration signal with respect to time;

compensating the adjusted amount of fuel permitted to flow into said engine by said engine condition signals in accordance with said air-fuel correction signal;

generating a signal corresponding to a mean value of said air-fuel ratio correction signal;

adjusting at least one of said functional relationships in accordance with said generated mean value signal; and, repeating the above sequence of steps so that the said means value signal continuously approaches a predetermined value equivalent to the value of the air-fuel ratio correction signal when the compensated amount of fuel supplied in accordance with the air-fuel ratio correction signal becomes zero.

2. An air-fuel ratio control method as claimed in claim 1, wherein said mean value of said air-fuel ratio correction signal is a man value of the maximum value and the minimum value of said air-fuel ratio correction signal.

3. An air-fuel ratio control method as claimed in claim 1, wherein said concentration sensing step respectively generates two different electrical voltage levels in response to the concentration of a predetermined component contained in the exhaust gas, and said mean value is a mean value of said air-fuel ratio correction signal at the time when one of said two voltage levels generated by said concentration sensor is being changed to the other of said two levels.

4. An air-fuel ratio control method as claimed in claim 1, wherein said engine condition signals include a signal which indicates the quantity of air taken into said engine and a signal which indicates the rotational speed of said engine.

5. An air-fuel ratio control method as claimed in claim 4, wherein said functional relationship adjusting step includes the step of correcting a function representing the relationship between an engine condition signal and a detected operating condition which indicates the quantity of air taken into said engine.

6. An air-fuel ratio control method as claimed in claim 1, wherein said engine condition signals and said detected operating conditions are represented as voltage signals, and said functional relationship adjusting step includes the step of correcting the voltage conversion ratio between the detected operating condition voltage signals and the engine condition voltage signals by means of a mechanical voltage-correction means.

7. An air-fuel ratio control method as claimed in claim 6, wherein said mechanical voltage-correction means includes at least one rheostat and at least one pulse motor for driving said rheostat in accordance with said generated mean value signal.

8. An air-fuel ratio control method as claimed in claim 1, wherein said functional relationship adjusting step includes a step of adjusting at least one of said functions stored in a digital computer which is programmed to correct the stored function in accordance with said generated mean value signal.

9. An air-fuel ratio control method as claimed in claim 1, wherein said functional relationship adjusting step is executed while said engine is driven under normal operating conditions.

* * * * *